US006840648B2

(12) United States Patent
Bryant et al.

(10) Patent No.: US 6,840,648 B2
(45) Date of Patent: Jan. 11, 2005

(54) CONNECTOR FOR GLOW STICKS HAVING DISPLAY AREA

(75) Inventors: Robert Bryant, Brentwood Bay (CA); Greg Dombowsky, Victoria (CA)

(73) Assignee: Northern Light Products, Inc., Victoria (GB)

( * ) Notice: Subject to any disclaimer, the term of this patent is extended or adjusted under 35 U.S.C. 154(b) by 0 days.

(21) Appl. No.: 10/343,148

(22) PCT Filed: Jul. 25, 2001

(86) PCT No.: PCT/CA01/01079

§ 371 (c)(1),
(2), (4) Date: Jun. 26, 2003

(87) PCT Pub. No.: WO02/07556

PCT Pub. Date: Jan. 31, 2002

(65) Prior Publication Data

US 2004/0100790 A1 May 27, 2004

Related U.S. Application Data

(60) Provisional application No. 60/225,028, filed on Jul. 25, 2000.

(51) Int. Cl.[7] ..... F21K 2/06

(52) U.S. Cl. ..... 362/84; 362/101; 63/3; 63/3.1; 24/700; 24/697.1

(58) Field of Search ..... 362/84, 104; 40/633; 24/700, 697.1, 605, 588; 63/3, 3.1

(56) References Cited

U.S. PATENT DOCUMENTS

| | | | | | |
|---|---|---|---|---|---|
| 4,061,910 | A | | 12/1977 | Rosenfeld | 362/34 |
| 4,317,337 | A | | 3/1982 | Walden | 63/3 |
| 4,508,642 | A | * | 4/1985 | World | 252/700 |
| 5,222,797 | A | * | 6/1993 | Holland | 362/34 |
| 5,323,554 | A | * | 6/1994 | MacDonald | 40/633 |
| 5,383,100 | A | | 1/1995 | Kikos | 362/34 |
| 5,782,107 | A | * | 7/1998 | Glanz | 63/3 |

FOREIGN PATENT DOCUMENTS

| | | |
|---|---|---|
| FR | 2639420 | 5/1990 |

* cited by examiner

*Primary Examiner*—Laura K. Tso
(74) *Attorney, Agent, or Firm*—Kolisch Hartwell, P.C.

(57) ABSTRACT

A connector for glow sticks having first and second engaging members for engaging first and second ends of a glow stick. Positioned above the engaging members is a display area for the display of advertising or other information. The engaging members are typically shaped to fit the generally cylindrical glow stick. The ends of the glow stick are inserted into the engaging members, allowing the glow stick to function as a necklace or bracelet while displaying advertising, for example the logo of the sponsor of an event the user is attending.

10 Claims, 6 Drawing Sheets

CONNECTOR FOR GLOW STICKS HAVING DISPLAY AREA

This application is the national stage of international application No. PCT/CA01/01079, filed Jul. 25, 2001, entitled CONNECTING DEVICE, which designates the United States, and which itself claims the priority of U.S. provisional application Ser. No. 60/225,028, filed Jul. 25, 2000, each of which applications is incorporated by reference in its entirety.

NOTICE REGARDING COPYRIGHTED MATERIAL

A portion of the disclosure of this patent document contains material which is subject to copyright protection. The copyright owner has no objection to the facsimile reproduction by anyone of the patent document or the patent disclosure as it appears in the public Patent Office file or records but otherwise reserves all copyright rights whatsoever.

TECHNICAL FIELD

This invention relates generally to connectors for application with chemiluminescent glow sticks and particularly to such connectors that allow such glow sticks to be worn as jewellery.

BACKGROUND

The use of chemiluminescent glow sticks is seen commonly at entertainment events, such as concerts and sporting events. The glow sticks are frequently fashioned as flexible plastic tubes containing the chemiluminescent material, and it is often desirable that these tubes be maintained in a circular position to function as necklaces or bracelets. In order to maintain the glow sticks in such a shape a connector is employed to hold the ends of the glow stick in proximity.

An example of a connector for shaping glow sticks in disclosed in U.S. Pat. No. 4,317,337 to Walden et al. This device discloses a clasp for glowing liquid filled tubular jewellery. The connector holds the opposing ends of a glow stick in close proximity, and thereby maintains the glow stick in a ring shape. However, the connector does not allow for the convenient display of advertising.

As glow sticks are inexpensive, they are frequently given away as promotional items, for instance by an event's sponsors. Naturally, the sponsor, in such cases, wishes to associate themselves with the glow stick. In the prior art, advertising on glow sticks with connectors is done either (1) on the glow stick, itself, in which case a portion of the glow stick is necessarily darkened (and the glowing effect of the glow stick diminished); or (2) on the connector directly. As connectors known in the art are sized to closely match the diameter and shape of the tubular glow stick, there is little space available on the connector for advertising, which limits the size and shape of the advertisement. Another problem associated with imprinting advertisements on the glow stick directly is that when a hot stamp or pad print method is used on the glow stick, approximately 1–2% of the glow sticks will break on such imprinting.

What is needed is a glow stick connector capable of holding the opposite ends of a glow stick in a proximate position that also provides an area for the placement of advertising.

SUMMARY OF THE INVENTION

The connector is shaped to receive two ends of a glow stick. The connector can be manufactured to connect the opposite ends of glow sticks having the standard diameters of 4.9 mm, 5 mm, and/or 6 mm. The connector further has a display area that can perform a function as a corporate advertising and marketing tool.

The connector is made to receive the ends of a chemiluminescent light stick to create a necklace, bracelet, anklet or other circular object. The connector is preferably made of flexible, low cost, low density, polyethylene. There is preferably a partial separation at the centre of the connector under the display area which allows the connector to bend at such centre, allowing the bracelet, necklace or anklet to properly maintain its circular shape and to prevent the connector from breaking.

Another function of this connector is as a marketing tool. The display area is a preferably flat area on the connector which can be imprinted with virtually any likeness or corporate logo. The display area is preferably not a separate piece of the connector, so that the connector can be manufactured as a single piece. The display area is preferably slightly raised above the actual connector portion on a thin ridge running along the display area. The ridge helps to provide flexibility and also allows the connector to be mounted in a jig for hot stamping or pad printing of the display area. The mold for the connector is preferably designed to allow the display area to be manufactured in virtually any shape desired (i.e. oval, circle, square, bottle shape, letter(s), number(s), etc.) by incorporating an inexpensive interchangeable portion in the mold. This design addition allows the shape of the display area to be changed when needed at minimal cost.

The glow stick is secured to the connector by a tension fit. Preferably connector has engaging members that are female shaped and are designed to fit snugly to the glow stick ends. Tension is created when the connector is bent slightly to receive the ends of the glow stick. The tension generated thereby is sufficient to hold the ends of the glow stick firmly in the connector engaging members.

BRIEF DESCRIPTION OF FIGURES

Further objects, features and advantages of the present invention will become more readily apparent to those skilled in the art from the following description of the invention when taken in conjunction with the accompanying drawings, in which.

DETAILED DESCRIPTION OF PREFERRED EMBODIMENTS

For the purposes of this specification and appended claims (but not for the purposes of describing the prior art), the term "display area" means a portion of the connector described herein that is suited for displaying information on the exterior of the glow stick or engaging member, i.e. the information is not within the glow stick or engaging member. The display area includes, but is not limited to a flat surface branded with a logo, letters and/or numbers; a flat logo, numbering or lettering; a aesthetically pleasing design; or a three dimensional shape, such as a figure or decorative pendant.

Figure 1:
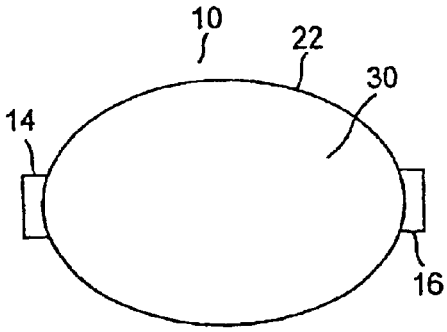
FIG. 1 is a top view of an embodiment of a connector according to the invention.
Figure 2:
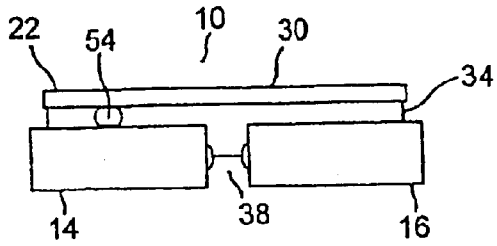
FIG. 2 is a side view thereof.
Figure 3:
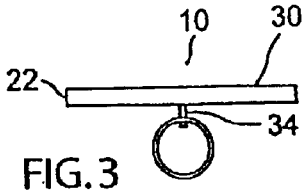
FIG. 3 is a front view thereof.
Figure 4:
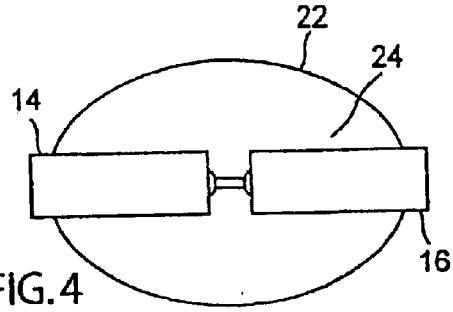
FIG. 4 is a bottom view thereof.
Figure 5:
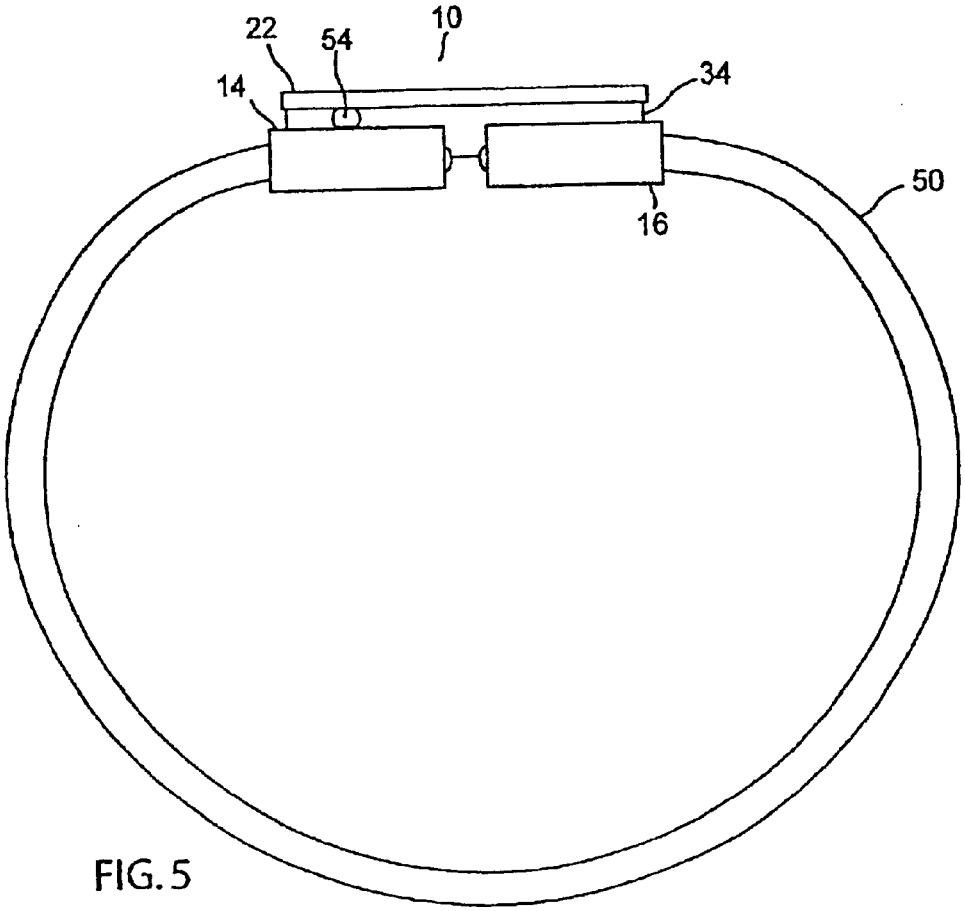
FIG. 5 is a side view thereof showing the connector in use.
Figure 6:
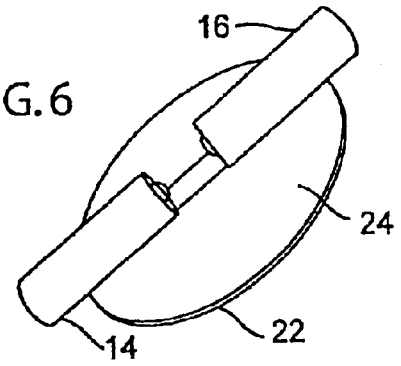
FIG. 6 is a perspective view of an alternative embodiment of the invention.

As seen in FIG. 1, a glow stick connector 10 according to the invention comprises first and second engaging members 14, 16, respectively for engaging opposite ends of a glow stick 50. First and second engaging members 14, 16 are generally cylindrically shaped and are sized to secure a glow stick by a tension fit. To perform this function first and second engaging members 14, 16 are usually female shaped, but may be male shaped if the glow stick has a corresponding female shape. The opposite ends of the glow stick 50 are placed into first and second engaging members 14, 16, respectively, of the connector 10 which allows the glow stick 50 to fit snugly, as seen in FIG. 5. The connector 10 is preferably bent slightly when the opposite glow stick ends are being placed in first and second engaging members 14, 16 thereby creating tension. This tension generated holds the ends of the light stick firmly in the first and second engaging members 14, 16 of the connector 10. As well, the glow stick ends are held in position within engaging members 14, 16 by a friction fit.

Engaging members 14, 16 are preferably female shaped, but many other means of engaging glow stick ends may be used. For example, clasps, clips, and other means known in the art may be employed. In some embodiments of engaging members, for example clips, the members may engage the glow stick at any point along the glow stick, rather than at the ends thereof.

Glow stick 50 is typically manufactured from low density polyethylene. Likewise, the connector 10 is preferably manufactured from low density polyethylene, although other materials may be used, such as polypropylene. Low density polyethylene not only provides flexibility but also helps keep the costs of the connector 10 and the glow sticks low. The connector 10 can be easily manufactured using a plastic injection mold system.

Figure 8:
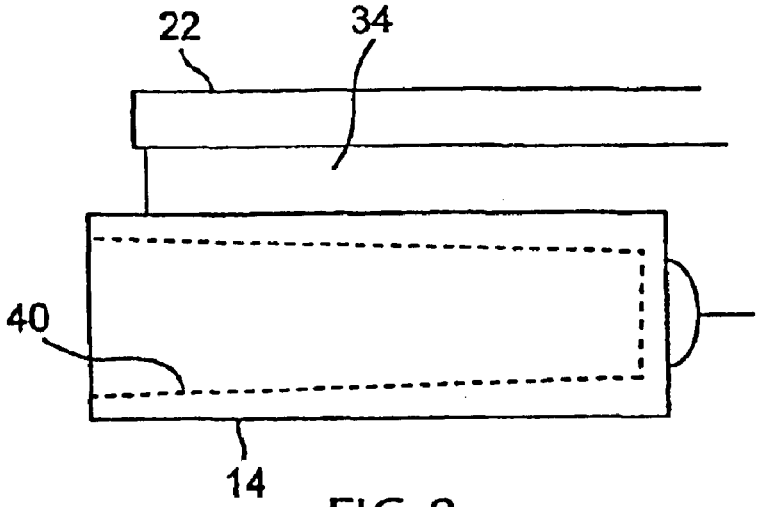
FIG. 8 is an interior view of an engaging member of a connector showing the conical shape thereof.
Figure 9:
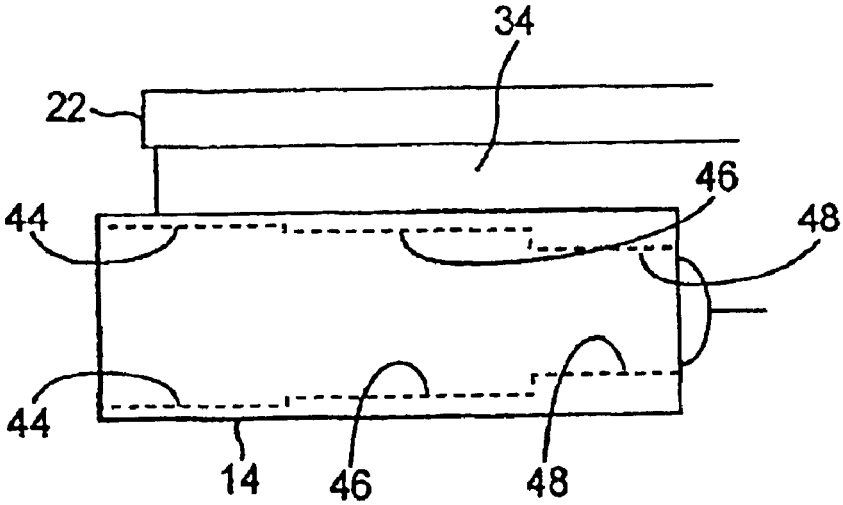
FIG. 9 is an alternative embodiment of an engaging member of a connector showing the discrete radii for different sizes of glow sticks.

The connector 10 may be designed to be used with glow sticks having different lengths and radii. The connector 10 can easily be manufactured to hold the opposite ends of glow sticks having diameters of 4.9 mm, 5 mm, or 6 mm, those that are most commonly found in the industry. First and second engaging members 14, 16 may be sized to fit a particular size of glow stick, or they may be fashioned to receive all of the commonly sold sizes. In one embodiment of engaging members for receiving more than one size of glow stick, as seen in FIG. 8, the interior surface 40 of engaging member 14 has a conical shape, narrowing towards the centre of the connector 10. In such an embodiment, the larger the diameter of the glow stick end, the less needs to be inserted into engaging member 14 to fit securely. In a further embodiment, as seen in FIG. 9, the interior 42 of engaging members 14, 16 may has discrete layers 44, 46, 48 such that outer portion 44 is sized to engage a 6 mm glow stick, centre portion 46 is sized to engage a 5 mm glow stick and the inner portion 48 is sized to engage a 4.9 mm glow stick.

The connector 10 further comprises a display area 22 that can function as a corporate advertising and marketing tool. Display area 22 is preferably secured to first and second engaging members 14, 16 and helps maintain first and second engaging members 14, 16 in a spaced relationship. Optionally, the lower surface 24 of display area functions as a top portion of first and second engaging members 14, 16. Display area 22 may have a flat surface 30 that can easily be imprinted with a company name, trademark or product. Alternatively, display area 22 may be a word or a letter, or may not have a flat surface. Preferably, display area 22 is not a separate piece of the connector 10; allowing connector 10 to be manufactured as a single piece, although alternative embodiments of the invention (not shown) may allow display area 22 to be attached or removed from a frame holding engaging members 14, 16.

Display area 22 may be slightly raised above first and second engaging members 14, 16 on a thin ridge 34 running at least partially along the length of the display area 22. Ridge 34 assists in providing flexibility and may be used to allow the connector 10 to be mounted in a jig for hot stamping or pad printing. Preferably centre portion 38 of ridge extends downwardly between first and second engaging members 14, 16. If ridge 34 is not present, display area 22 can be positioned directly on engaging members 14, 16. Ridge 34 or display area 22 may include an aperture 54 so that connector 10 can function as a key chain or the like.

Figure 7A:
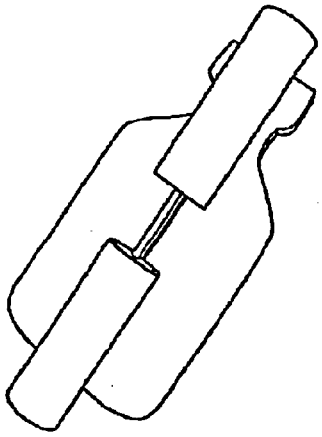
FIGS. 7A through 7P are perspective views of embodiments of the invention showing a selection of shapes available for the display area.
Figure 7B:
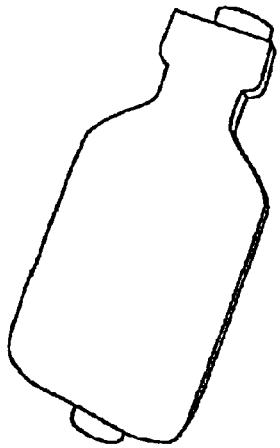
Figure 7C:
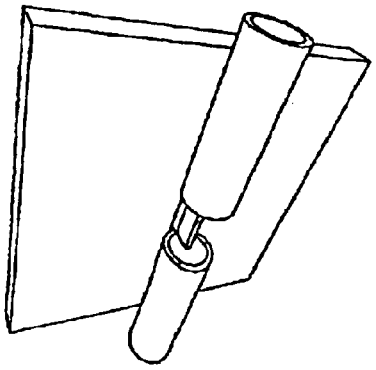
Figure 7D:
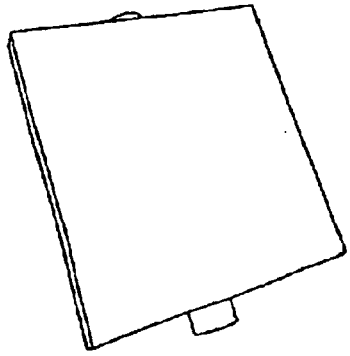
Figure 7E:
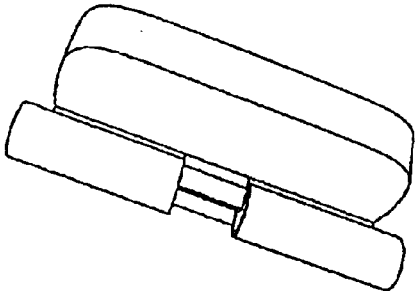
Figure 7F:
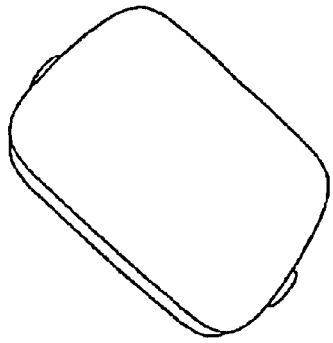
Figure 7G:
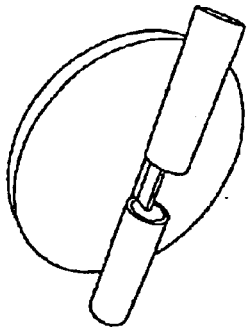
Figure 7H:
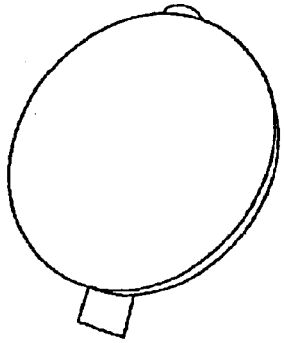
Figure 7I:
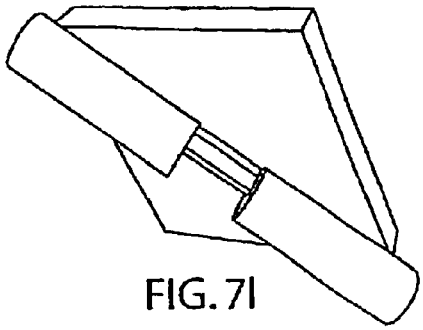
Figure 7J:
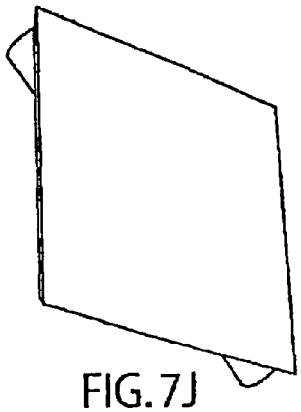
Figure 7K:
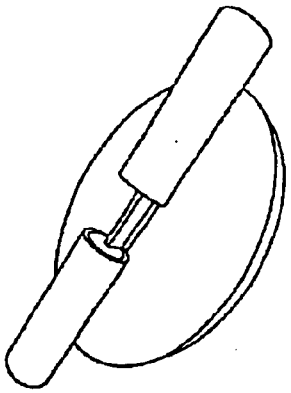
Figure 7L:
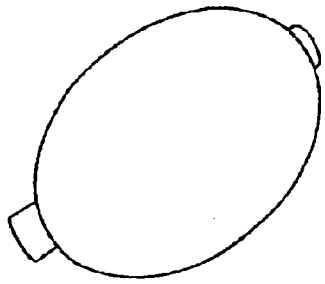
Figure 7M:
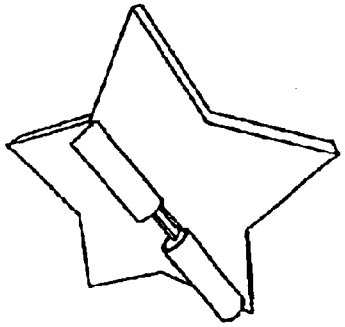
Figure 7N:
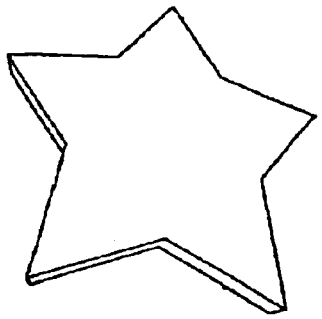
Figure 7O:
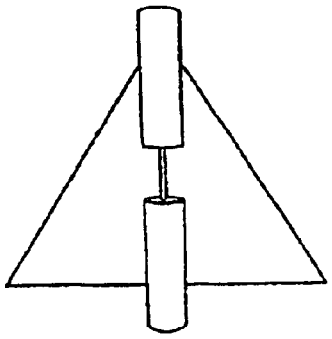
Figure 7P:
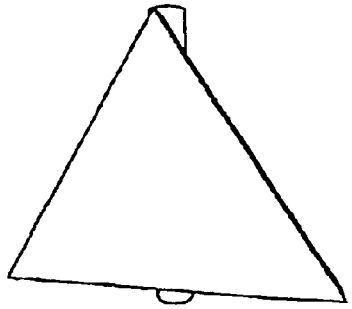

The mold for the connector 10 is preferably designed to allow the display area to be manufactured in virtually any shape desired (i.e. oval, circle, square, bottle shape, letter, number, word, etc.) by incorporating an inexpensive interchangeable portion in the mold. Examples of several different shapes of connectors are shown in FIGS. 7A through 7P. Such a mold allows the shape of the display area 22 to be changed as desired at a low cost.

In a preferred embodiment, the mounting jig used in imprinting the connector 10 with the desired display is an eight sided aluminium member with a thickness of less than one inch. Apertures are positioned in the sides of the jig with a slot cut from the aperture to the surface of the jig to hold the connector parts snugly and support the stamping process while curtailing movement of the connector.

Connector 10 allows opposing ends of a chemiluminescent glow stick to be engaged with both first and second engaging members 14, 16, respectively to create a necklace, bracelet or anklet. In use, either before or after purchase by the user, an end of the glow stick is placed in a first engaging member 14 of the connector 10, following which the opposite end of the glow stick is placed in second engaging member 16. In a preferred embodiment, there is a partial separation between first and second engaging members 14, 16, positioned at center portion 38 below display area 22, which allows the connector 10 to bend at its midpoint, so that the glow stick, may maintain a circular shape. A user may use multiple connectors to establish a chain of glow sticks, i.e. in a single connector 10 each engaging member 14, 16 may receive an end of a different glow stick.

As described above, the connector 10 can be used to connect the opposite ends of glow sticks having a diameter of 4.9 mm, 5 mm, or 6 mm. The mold used to manufacture the connectors can be easily adjusted, by changing the pins in the mold, to manufacture connectors made for any of these standard sizes of glow sticks (or for the connectors described above that receive more than one size of glow stick).

In an alternative embodiment of the connector, the ridge 34 need not be present and the connector 10 can be manufactured from a more rigid material, such as clarified polypropylene. In yet another alternative embodiment, a tab may be placed in the display area 22, allowing the connector to be used as a key chain.

In another embodiment of the invention display area 22, rather than displaying advertising, may have decorative features, and thereby function as a pendant for a glow stick necklace or bracelet. Display area 22 may be used to display commercial information, such as brands, trademarks or logos, or serve a purely decorative function.

Figure 10:
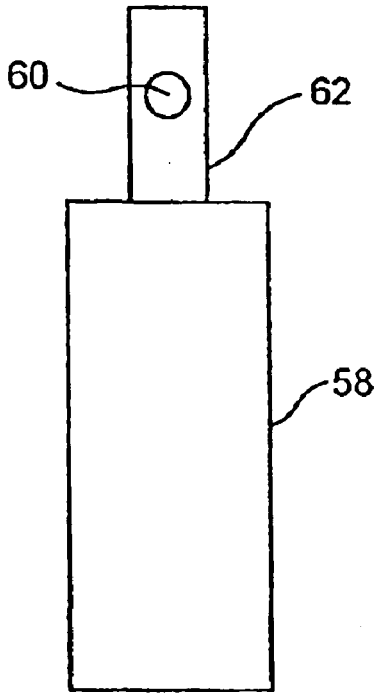
FIGS. 10 and 11 are a side and front views respectively, of an attachment for use with an alternative embodiment of the invention.
Figure 11:
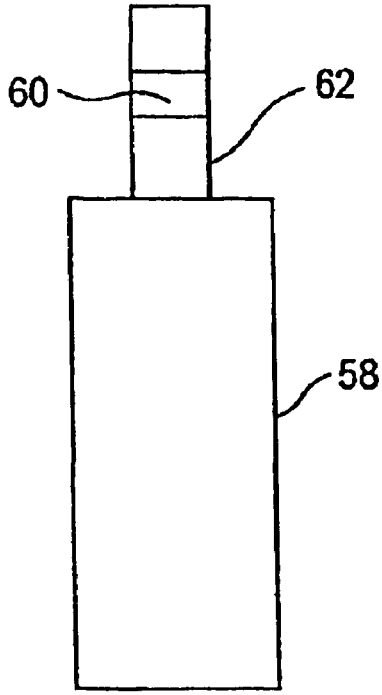

In yet another embodiment of the invention, the separation between engaging members 14, 16 can be shaped to receive an attachment, such as a pendant or advertisement. The attachment will have an attachment member shaped to fit securely between engaging means 14, 16. For example, if engaging means 14, 16 are shaped as hollow tubes, the attachment member may be shaped to fit both of such tubes, and can be easily detached from connector 10 when desired. The engaging members are capable of engaging the ends of a glow stick at the same time as the attachment member. In such an embodiment, display area 22 may not be present, as the display can be presented on the attachment. Alternatively, engaging members 14, 16 may be closed on the side facing the interior and have abutments on such closed side for receiving an attachment member 62. Such an attachment 58 is seen in FIGS. 10 and 11, and attachment member 62 includes an aperture 60 for receiving the abutments.

There are many other variations on the connector possible without departing from the spirit of the invention. For example other means of connecting the glow stick to first and second engaging members 14, 16 are possible such as by a friction fit or ultrasonic gluing.

While the principles of the invention have now been made clear in the illustrated embodiments, it will be immediately obvious to those skilled in the art that many modifications may be made of structure, arrangements, and algorithms used in the practice of the invention, and otherwise, which are particularly adapted for specific environments and operational requirements, without departing from those principles. The claims are therefore intended to cover and embrace such modifications within the limits only of the true spirit and scope of the invention.

What is claimed is:

1. A connector for a glow stick having first and second ends, comprising:

a tubular first engaging member for receiving a glow stick end;

a tubular second engaging member for receiving a glow stick end;

a display area for displaying information mounted to at least one of the first engaging member or the second engaging member, the display area being positioned tangentially in relation to the said first engaging member or second engaging member and the display area being larger than and extending beyond the cross-section dimension of said first engaging member or second engaging member.

2. The connector of claim 1, wherein said connector first and second ends are of a cylindrical shape.

3. The connector of claim 1, wherein said connector first and second ends are opposed.

4. The connector of claim 1, wherein said display area is centered at the midpoint between said connector first and second ends.

5. The connector of claim 1, wherein the display area is an ornamental geometric shape.

6. The connector of claim 5, wherein the ornamental geometric shape is one of an oval, a square, a circle, a rectangle, a bottle, a star, a triangle, a letter or letters, a number or numbers, or a word.

7. A connector for a glow stick having first and second ends, comprising:

a first engaging member for receiving a glow stick end;

a second engaging member for receiving a glow stick end;

a display area for displaying information, said display area comprising a pendant.

8. The connector of claim 7, wherein said display area displays advertising.

9. A connector for a glow stick having first and second ends, comprising:

a first engaging member for receiving a glow stick end;

a second engaging member for receiving a glow stick end;

a display area for displaying information;

an interior of said engaging members being cone shaped.

10. A connector for a glow stick having first and second ends, comprising:

a first engaging member for receiving a glow stick end;

a second engaging member for receiving a glow stick end;

a display area for displaying information;

an interior of said engaging members having a plurality of discrete diameters.

* * * * *